United States Patent [19]

Massoudi

[11] Patent Number: 5,050,290

[45] Date of Patent: Sep. 24, 1991

[54] PROCESS FOR MANUFACTURING OF A LOST CASING FROM MODULAR FRAMES

[75] Inventor: Ahmad Massoudi, Tehran, Iran

[73] Assignee: Darya Paye Jetty Co. Ltd., United Kingdom

[21] Appl. No.: 373,790

[22] Filed: Jun. 29, 1989

[30] Foreign Application Priority Data

Jul. 1, 1988 [NL] Netherlands ..... 8801677

[51] Int. Cl.[5] ..... B23P 19/04; E02D 7/00

[52] U.S. Cl. ..... 29/455.1; 29/423; 52/437; 52/731; 249/10; 249/44; 249/144; 405/232

[58] Field of Search ..... 29/525.2, 423, 424, 29/428, 527.3, 527.4, 530, 455.1; 52/245, 247, 437, 698, 731; 249/10, 1, 13, 18, 19, 48, 44, 144, 188; 405/12, 14, 232, 204, 217, 205; 264/31; 269/901, 904, 910; 137/567

[56] References Cited

U.S. PATENT DOCUMENTS

| | | | |
|---|---|---|---|
| 1,137,601 | 4/1915 | Gallo | 405/12 X |
| 1,967,490 | 7/1934 | White | 405/14 |
| 3,071,837 | 1/1963 | Cerutti | 249/10 |
| 3,849,996 | 11/1974 | Mittleman | 405/12 |
| 4,014,177 | 3/1977 | Jarlan | 405/205 |
| 4,018,057 | 4/1977 | Erzen et al. | 405/205 X |
| 4,427,320 | 1/1984 | Bhula | 405/217 X |
| 4,648,752 | 3/1987 | Guy et al. | 405/217 |
| 4,824,290 | 4/1989 | Masoudi | 249/10 X |

FOREIGN PATENT DOCUMENTS

| | | | |
|---|---|---|---|
| 1814765 | 6/1970 | Fed. Rep. of Germany . | |
| 741857 | 2/1933 | France | 405/12 |
| 1338500 | 4/1963 | France . | |
| 301756 | 12/1929 | United Kingdom . | |

*Primary Examiner*—Joseph M. Gorski
*Assistant Examiner*—Peter D. Vo
*Attorney, Agent, or Firm*—Brumbaugh, Graves, Donohue & Raymond

[57] ABSTRACT

A method is disclosed for manufacturing a double-walled hollow lost casing for use in the production of marine engineering civil works having inner and outer walls each made of pre-cut plates of such size and shape that the lost casing has a polygonal cross-section throughout its height. The method includes the steps of assembling a jig by interconnecting a plurality of standard frames stacked upon each other to a desired height which together present an outer surface generally corresponding to a wall of a lost casing to be produced, assembling on and releasably attaching the pre-cut plates to the outer surface of the jig and seamlessly joining the assembled plates, and then releasing the completed wall from the jig. The inner and outer walls of the casing can, if desired, be made on separated jigs, with the completed outer wall lifted from its jig and lowered over a completed inner wall, or the plates of the outer wall may be assembled on a completed inner wall, with the completed double-wall casing then lifted from the jig on which the inner wall was assembled.

15 Claims, 6 Drawing Sheets

PROCESS FOR MANUFACTURING OF A LOST CASING FROM MODULAR FRAMES

BACKGROUND OF THE INVENTION

The invention relates to a process for the manufacturing of a double-walled hollow lost casing having plane inner and outer surfaces, to be used in the production of marine engineering civil works, such as pier, a jetty, a reservoir etc. said lost casing being made with inner and outer walls of sheets which are pre cut to size and shape beforehand such that the lost casing in each horizontal section is inwardly and outwardly polygonal and at least in the lower part of the casing has outwardly and downwardly sloping inner and outer walls respectively, which form a sharp bottom edge.

Such a process can be deduced from the international patent application WO NO. 87/03026, laid open for inspection. This application describes a lost casing for the manufacturing of e.g. a pier or a jetty which comprises an inner wall and an outer wall, which both in each horizontal section have the shape of a polygon whilst the outer wall at least in the lower region flares downwardly and outwardly and forms with the inner wall, which also has a downwardly and outwardly widening portion, a sharp bottom edge. This casing is manufactured from steel plates which are welded upon one another at their edges with transverse connecting members between inner and outer wall plates. This hollow steel casing can be provided with reinforcing rods and at a suitable moment during the manufacturing of e.g. a pier can be filled with concrete to form a rigid column.

The manufacturing of such a lost casing can be further improved in order to speed up the production, in particular when the casings serve to manufacture columns or other elements of large dimensions in the vertical direction as well as in the horizontal direction. With large dimensions rigidity and support is necessary during the manufacturing because the not yet finished casing has no inherent stability.

SUMMARY OF THE INVENTION

According to the invention this first aim is achieved in that at least the inner wall is made by making use of an assembly jig, which itself is assembled by interconnecting a plurality of standard frames which in a spaced apart fashion are placed in vertical planes parallel to or at an angle to each other, which frames comprise vertical and horizontal beams as well as a downwardly and outwardly sloping beam in the lower outer region, which frames are interconnected at any rate at the outwardly turned side by means of horizontal beams of predetermined length upon which the inner plates of the lost casing are releasably attached and in a seamless way interconnected.

Accordingly the jig itself is assembled by making use of standard frames which can be prefabricated somewhere else or on the site from sections of predetermined dimensions so that the prefabrication can take place with low costs and unskilled labour.

Said frames are placed upright and then are interconnected again by standard beams, which interconnection can take place by means of welding or by means of bolts and the like. Said frames can be assembled to larger subassemblies and the standard frames can be placed spaced apart in parallel planes or planes which are at an angle to each other. The last mentioned type usually will be necessary at the corners of a casing.

Not only the inner wall of the lost casing but also the outer wall can be made on a separate assembly jig made from interconnected standard frames, which outer wall after its manufacturing can be released from the assembly jig, can be lifted and can be lowered over the inner wall of the lost casing, which still is or no longer supported by the assembly jig for the inner wall whereafter the two walls are interconnected and the casing obtained in this way is lifted from the inner jig assembly. Disassembly of the inner jig is of course possible as well.

Preferably the inner wall is provided with outwardly projecting spacers with connecting means, such as bolts, after or during the manufacturing of the inner wall of the lost casing upon the assembly jig. One then has the possibility to interconnect inner and outer wall directly with each other by means of said spacers but in case no outer wall jig is used it is possible as well to attach the pre-cut sheets of the outer wall of the lost casing to the spacers one by one and interconnect them with each other in a seamless manner.

In both cases it is advantageous to provide the outer wall sheets with openings which correspond in place and distance to the place and distance of the spacers, said spacers having a length such that they can extend through the openings, have an abutment for the sheets engaging the edges of the openings and have means for connecting the outer wall or wall sheets to the spacers. Such a spacer can be a simple bolt, attached to an inner wall sheet by means of screw thread or welding, can have an outer end provided with screw thread with a collar below it for supporting the sheet of the outer wall which sheet then is attached by screwing a nut upon the protruding screw threaded end of the bolt.

If desired concrete reinforcing rods can be attached to the outer face of the inner wall of the lost casing by means of spacing elements between said wall and said rods prior to attaching the outer wall or wall sheets, which spacing elements are known in itself in the art of manufacturing concrete objects.

To obtain the possibility of manufacturing lost casings of varying sizes and shapes on the basis of the principles of the invention and with the aim to further simplify and speed-up production the invention also deals with several constructional possibilities for the frames.

Thus according to the first proposal the frame to be used with the process of the invention can be characterized in that each standard frame itself is composed of a plurality of rectangular standard subframes as well as one triangular subframe. By means of a plurality of said rectangular subframes and said one triangular subframe a standard frame with a dimension corresponding to the entire height of the jig to be manufactured can be assembled.

Preferably all rectangular subframes of such a frame have the same width, seen in the plane of the frame, but have a height chosen out of a series of standard heights. Said standard heights can have a mutual ratio from e.g. 1:2:3:4 so that by combining several frames with different heights a great variety of heights of the jig can be obtained.

To further facilitate the assembly of the jig subframes of one specific standard height by means of horizontal beams can be interconnected to form a tridimensional rectangular parallelipiped. Thus box-shaped open frames are obtained which can be placed next to and upon each other and interconnected in a simple way e.g. by means of bolts and since they are stable themselves there is no need to keep them upright during the interconnection of said frames by means of the horizontal beams to which the plates of the inner or outer casing have to be attached.

The same can be done in the bottom region in that at least two triangular frames are interconnected by means of horizontal beams to form a tridimensional frame the length of said horizontal beams corresponding to the horizontal distance between subsequent vertical standard frames. Said triangular frames accordingly have the same width as the tridimensional rectangular frames, accordingly can be placed next to such a rectangular frame and interconnected one to the other by means bolts through holes or vertical beams placed against each other.

At a corner of the polygonal it is possible to compose the frame of two vertical frames or subframes placed with their planes at an angle with respect to each other and interconnect said frames by means of horizontal beams such that in plan view they have the shape of a triangular or equally sided trapezium. Such a frame can be used as sole frame type for assembling a jig. E.g. an octogonal lost casing can be made by using eight frames of this type.

Instead of using frames for each side of the polygonal it is according to the invention possible as well to use a frame as standard element which comprises at least two outer vertical beams, one for each opposite side of the inner wall of the lost casing to be manufactured, which vertical beams are interconnected at least at top and lower end by horizontal beams which span the width of the jig, said outer vertical beams at their lower end having an outwardly and downwardly inclined extension towars a horizontal bottom beam spanning the width of the jig.

With other words frames are used which extend from one side to the other side. Said frames need internal reinforcement which preferably is obtained by means of beams e.g. in that between the outer beams of the frame there is a triangular lattice frame.

A plurality of said frames can be interconnected to form a tridimensional frame as part of the jig.

Several types of frames and subframes have been described. They are easy to manufacture and assemble. They can be combined in any suitable way and in accordance with the demand at the side of the work dictated by the circumstances.

The pre-cut plates for inner and outer wall are for the majority rectangular plates. At the inclined wall portions, in particular at the corners, the use of trapezium shaped plates can be advantageous.

The detachability of the outer wall sheets in some cases can have the advantage that, after removal of the connecting means, said outer wall sheets can be removed or the entire wall be lifted off, once the concrete filling has set sufficiently.

The invention now will be explained with reference to the drawings.

DESCRIPTION OF THE PREFERRED EMBODIMENTS

Figure 1:
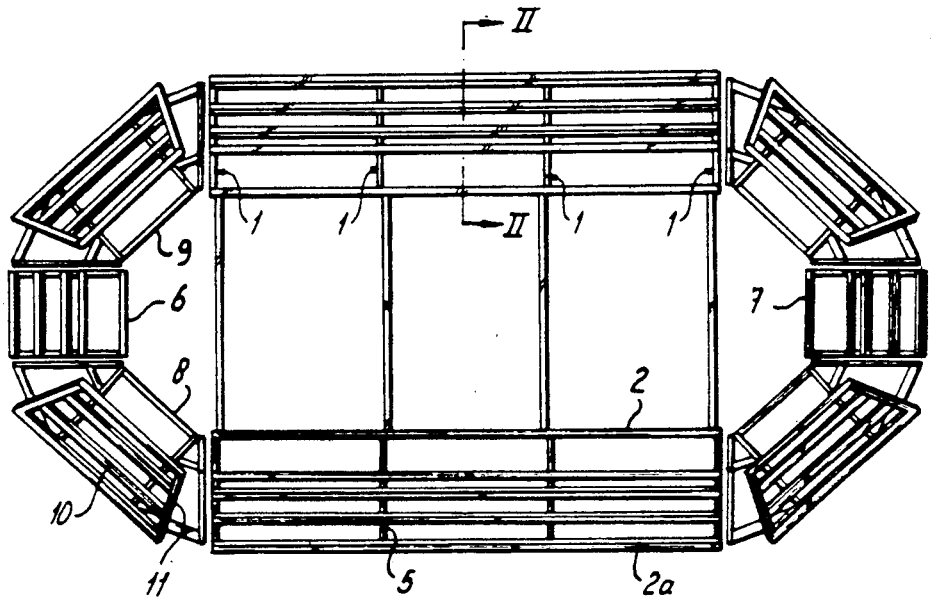
FIG. 1 shows schematically in top view a jig according to one embodiment of the invention.
Figure 2:
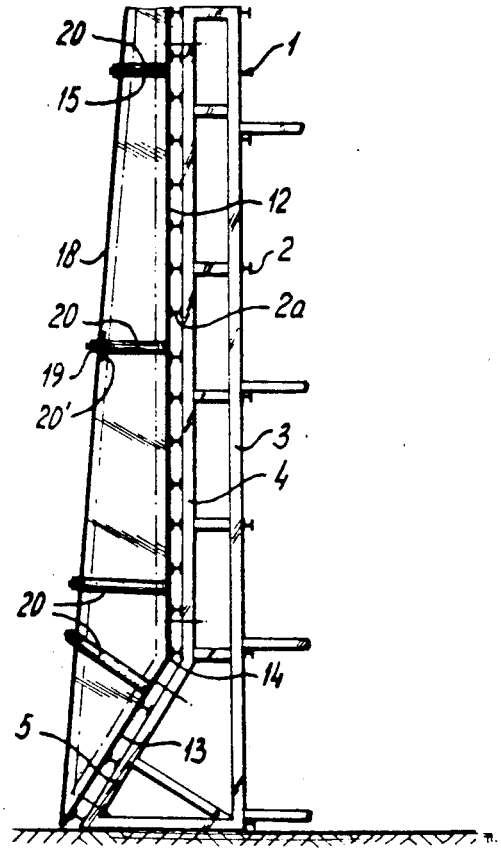
FIG. 2 is a cross section according to the line II—II of FIG. 1 with the sheets of the inner and outer wall being added.
Figure 3:
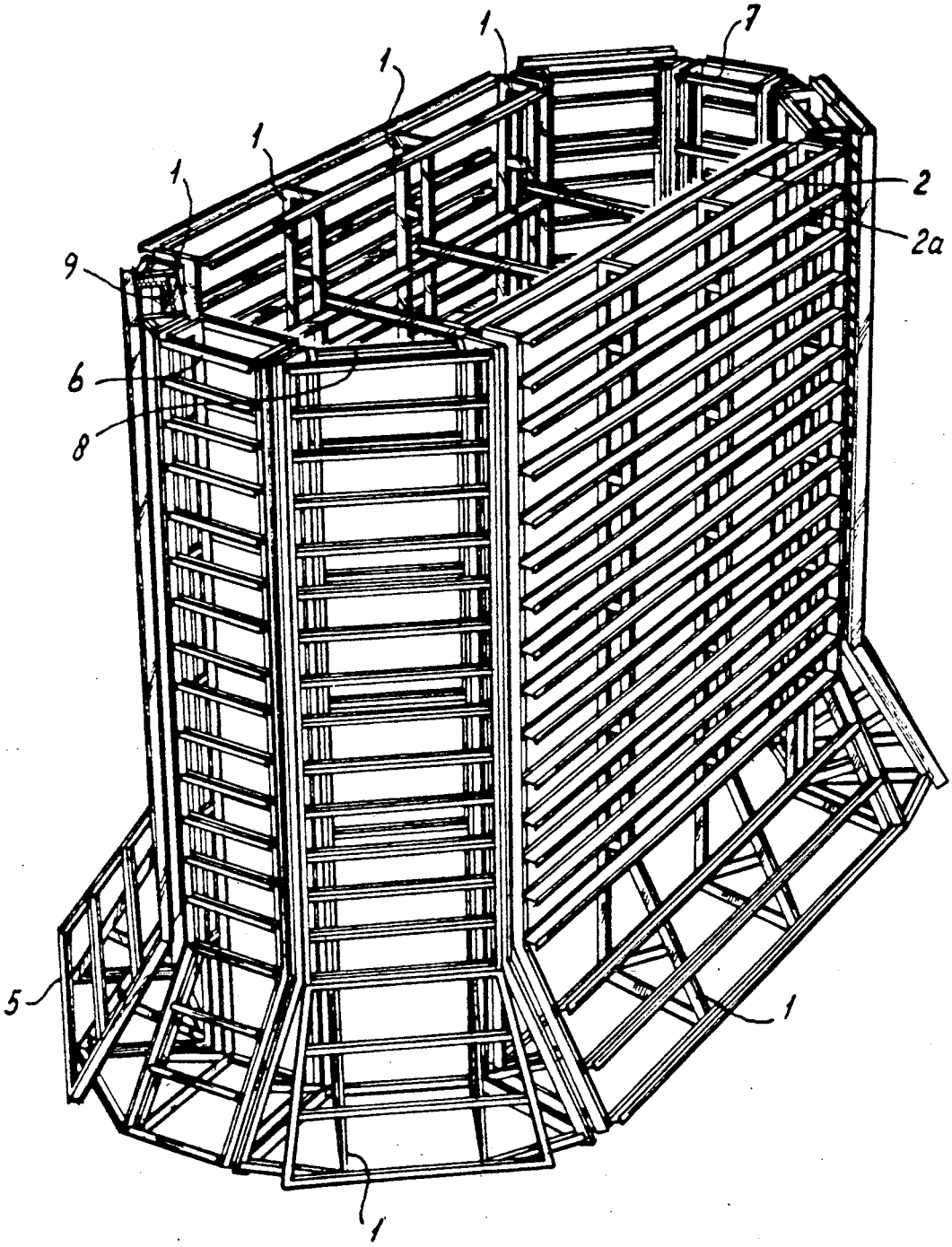
FIGS. 3 shows in perspective the embodiment of the jig of FIGS. 1 and 2.

The assembly jig shown in FIGS. 1, 2 and 3 comprises standard frames 1 placed in vertical planes which are interconnected by a plurality of horizontal beams 2. There are horizontal beams 2 at the inner side as well as horizontal beams **2*a* at the outer side to which the plates of the inner wall of the casing can be attached. Said beams may have a suitable profile such as the I-profile shown in FIGS. 2 and 3. Said vertical standard frames 1 are interconnected to form large side frames by means of long beams 2, 2*a*. Said frames are substantially rectangular in shape seen in top view and front view respectively. The rearside formed by the vertical beam 3 extends from top to bottom. The front beams 4 of the standard frames 1 extend from the top towards the outwardly and downwardly inclined beams 5**.

Instead of broad frames as shown for the long sides of the jig shown in FIGS. 1 and 3, frames of smaller width can be used such as the frames 6 and 7 or 8 and 9 as shown in FIG. 1.

The smaller frames like the frames 8 and 1 may have on the outer side horizontal beams 10 which together with side frames 11 form a trapezium.

The long frames can be composed of a plurality of smaller frames.

All frames can make use of sections of different cross section such as U-sections, I sections, L-sections and the like.

In the cross section shown in FIG. 2 the outer plates 12 and 13 of the inner wall of the lost casing are shown attached to the outer flanges of the beams **2*a***.

Said sheets can be interconnected by welding as e.g. shown at 14. Bolts 15 are fixed to said sheets, e.g. by welding or otherwise.

In FIG. 2 the outer sheets for the outer wall of the lost casing are indicated at 18.

They are attached to the bolts by means of nuts 19 on a screw threaded end of the bolt 15. The distance between inner and outer plate 12 and 18 respectively is obtained by means of a bush 20 shifted over the bolt 15.

Instead of a bush it is also possible to use a collar 20'.

After manufacturing the casing it can be released from the jig by removing the connection between the beams **2*a* and the inner plates 12** e.g.

Figure 4:
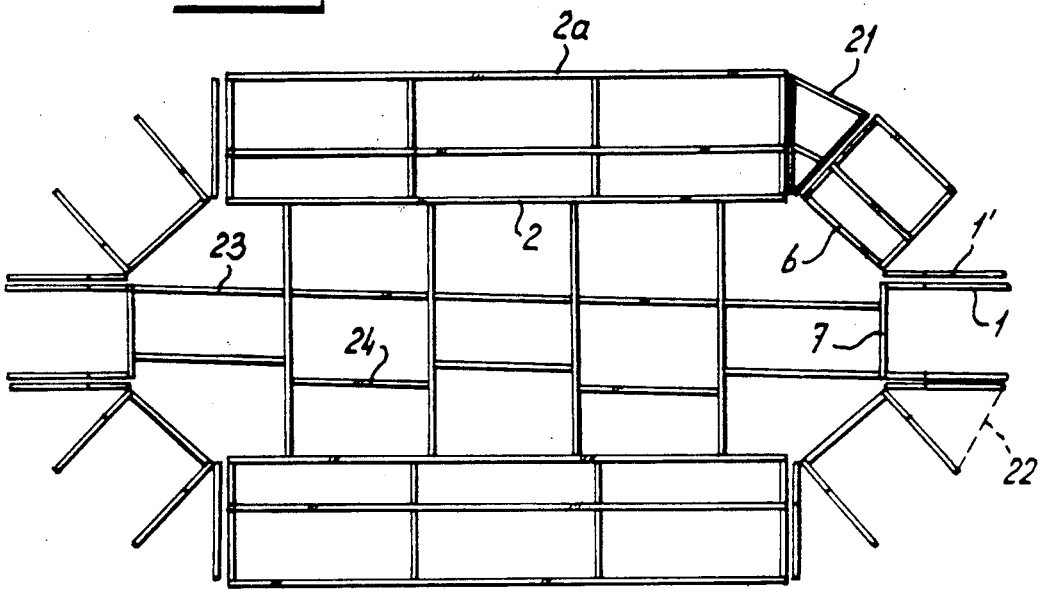
FIG. 4 shows schematically in top view the way standard frames can be placed and interconnected in a manner which differes from the one shown in FIG. 1.

FIG. 4 shows a slightly different embodiment.

Again frames 1 are used interconnected by horizontal beams such as 2 and 2a.

Also at the sides smaller frames 6 are used. The difference is that inbetween use is made either of triangular frames 21 by placing two standard frames 1 at a sharp angle to each other or by using an individual standard frame 1' parallel to the main frames 1 of the small frame 7 held in place by means of additional beams as indicated with the interrupted line 22.

Between the interconnected frames a reinforcing structure is shown formed by crossing means 22 and 23 which can be continuous or as shown at 24 made from short pieces.

Figure 5:
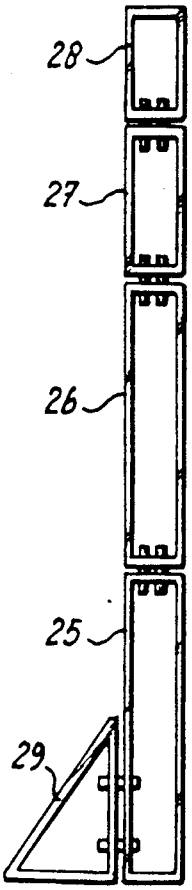
FIGS. 5, 6 and 7 show in a vertical side view different possibilities for assembling the standard frame from subframes.

FIG. 5 shows a standard frame assembled from a plurality of subframes. The subframes 25 and 26 have the same height. Frame 27 has a height which is half the height of the frames 25 or 26 and frame 28 is about ⅓ the height of frame 26. This assembly is completed by means of the triangular frame 29.

Figure 6:
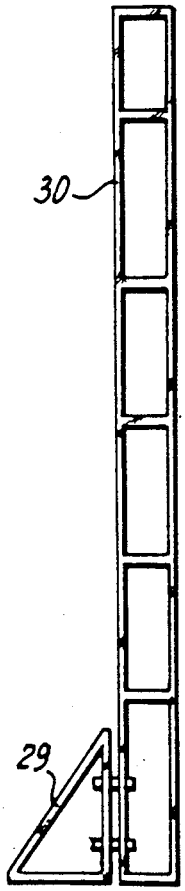

In FIG. 6 the standard frame is composed of a subframe 30 extending over the entire height combined with the triangular subframe 29.

Figure 7:
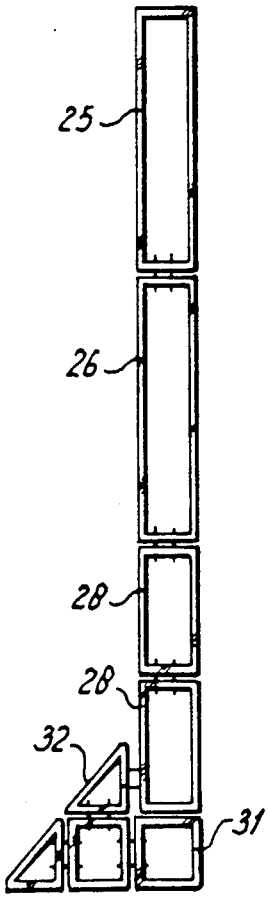

In FIG. 7 two subframes 25 and 26 are combined with two frames of the height of the frame 28. Further two square elements are used as well as two small triangular frames 32.

The width in the plane of the drawing is the same for all rectangular subframes.

Figure 8:
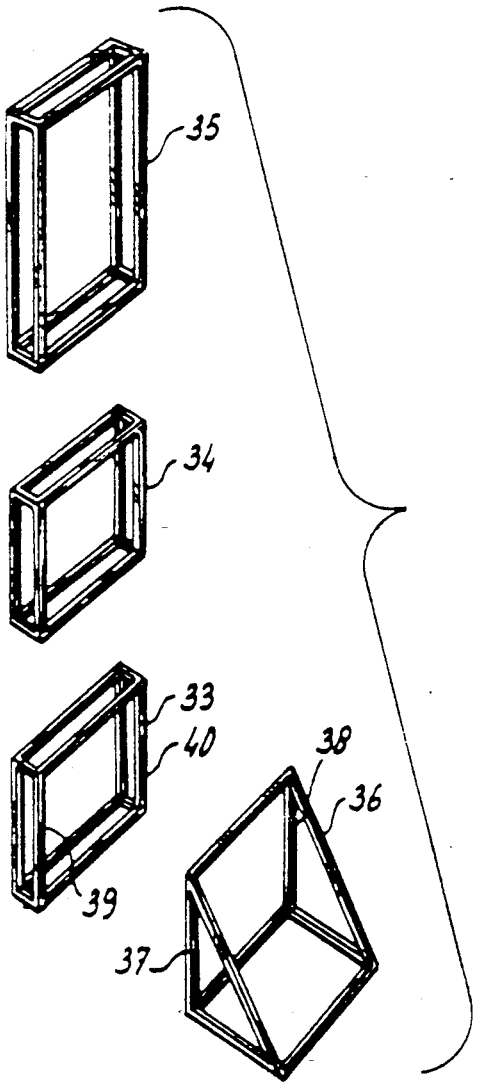
FIGS. 8 and 9 show in perspective view several possibilities of making frames from tridimensional subframes.

FIG. 8 shows tridimensional rectangular subframes 33, 34 and 35 of different heights but equal other dimensions. This standard frame is combined with a triangular frame 36 having a distance between the vertical beams 37 and 38 which is equal to the distance between the vertical beams 39 and 40.

Figure 9:
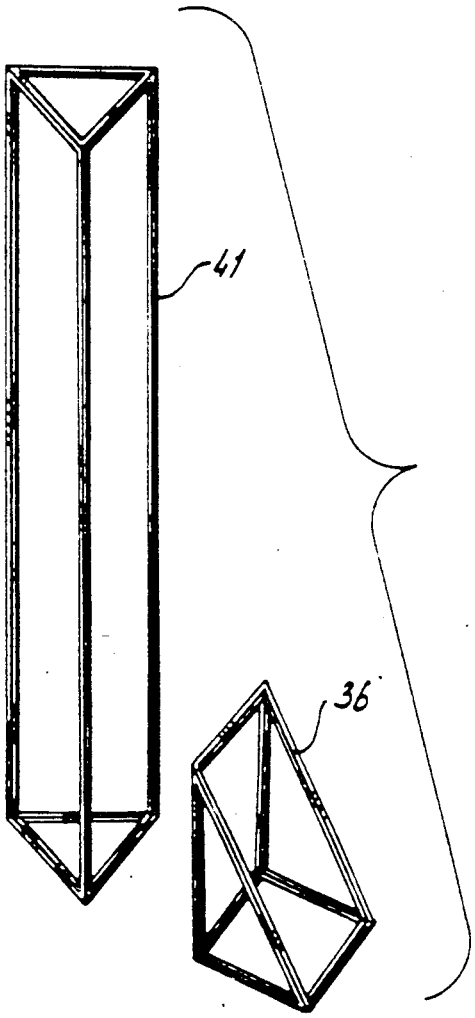

FIG. 9 shows a subframe of triangular horizontal cross section indicated with 41, combined with a triangular frame 36. The width of the sides of the subframe 41 has to be equal to the width of the vertical rectangular side of the frame 36.

Figure 10:
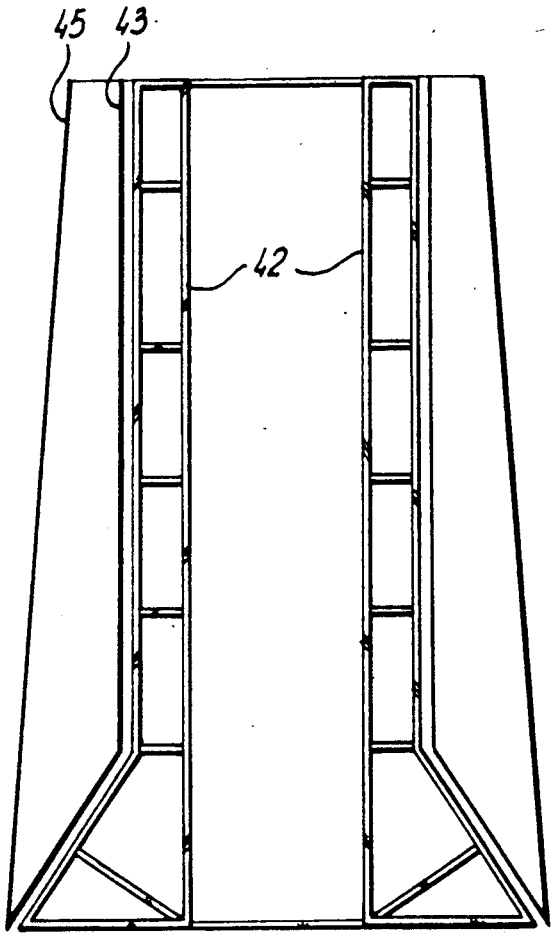
FIG. 10 shows in vertical cross section schematically a jig for the inner wall of the lost casing.

FIG. 10 shows in vertical cross section the jig 42 for manufacturing the inner wall 43.

Figure 11:
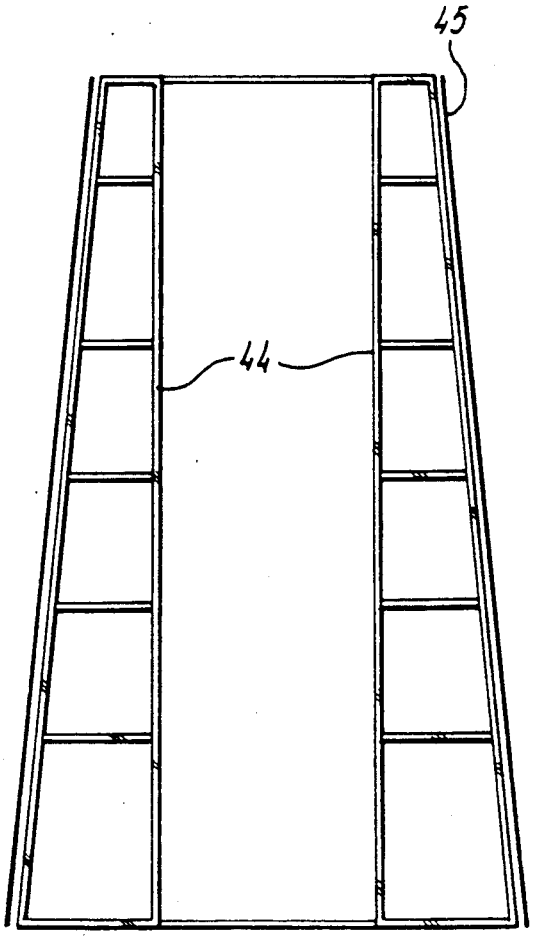
FIG. 11 shows in the same way as FIG. 10 a vertical cross section through the jig for manufacturing the outer wall of the lost casing.

FIG. 11 shows at the same scale the jig 44 for manufacturing the outer wall 45.

In FIG. 10 said outer wall 45 is placed over the inner wall to form the lost casing. The means interconnecting inner and outer wall are not shown, but can be the means shown in FIG. 2.

Figure 12:
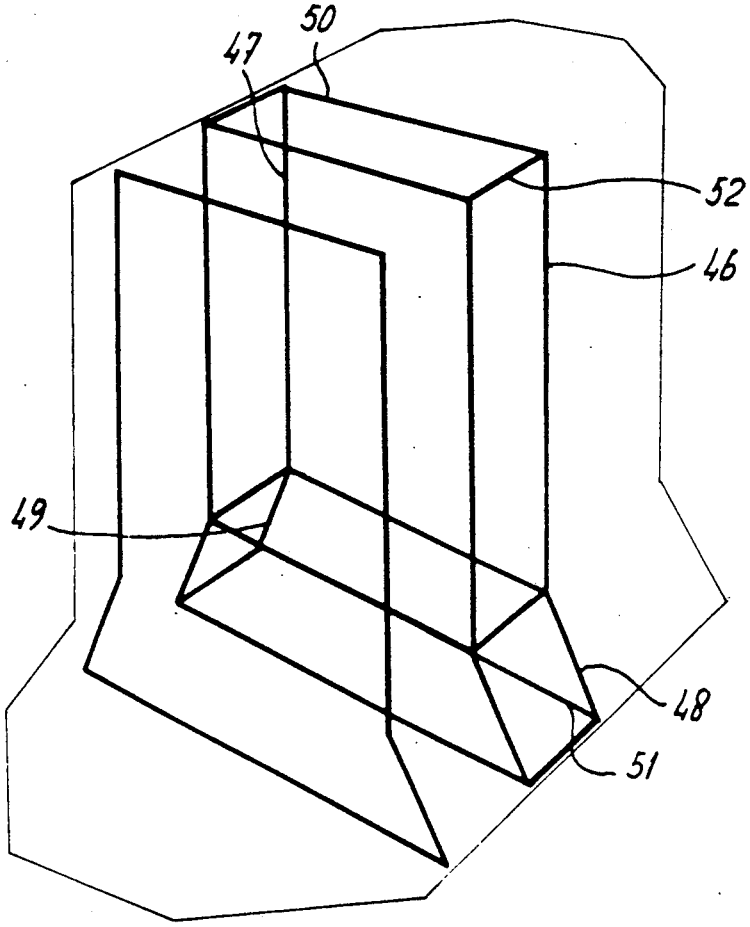
FIG. 12 shows schematically another embodiment for the frame.

FIG. 12 shows a tridimensional frame with outer beams 46, 47, which have a downwardly and outwardly extending lower part 48, 49 respectively and which are interconnected by horizontal beams 50 and 51 which span the entire width of the jig. Said frames 46, 47, 48, 49, 50, 51 can be combined into tridimensional frames by means of horizontal beams like 52.

To give said trimensional frames stability, several possibilities do exist.

Figure 13:
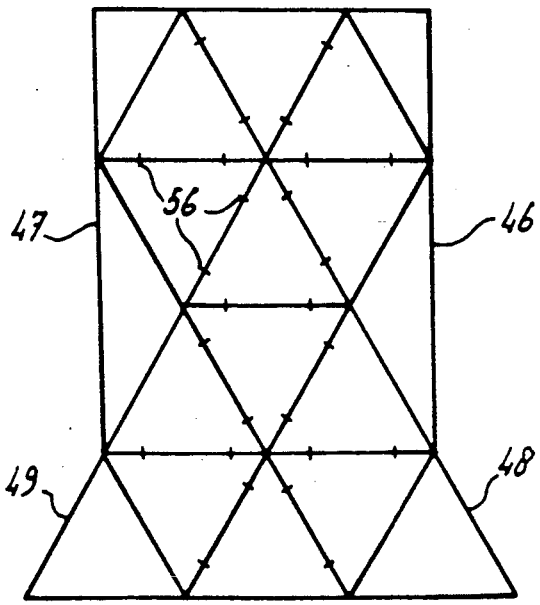
FIG. 13 shows schematically a lattice work for a frame of the type shown in FIG. 12.

FIG. 13 shows one possibility by placing between the vertical beams 46 and 47 a triangular lattice work which can fill the entire inner space in vertical and horizontal longitudinal and transverse direction.

Figure 14:
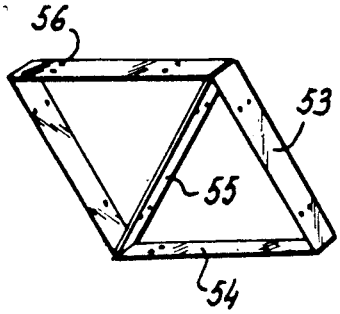
FIG. 14 is a perspective view of another frame construction.

Another possiblity is shown in FIG. 14 wherein a rectangular frame formed of horizontal beams 54 and 56 and vertical beams 53 is stabilized by a brace 55 extending between diagonally opposite corners.

I claim:

1. Method for manufacturing a double-walled hollow lost casing, for use in the production of marine engineering civil works including piers, jetties, reservoirs, having a bottom and planar, vertically-oriented inner and outer walls each made of assembled pre-cut plates of such size and shape that horizontal cross-sections of the lost casing at all vertical levels are inwardly and outwardly polygonal in shape, a lower portion of the casing adjacent the bottom slopes downwardly and outwardly, and the inner and outer walls are joined together to form a sharp edge around the perimeter of the bottom of the lost casing, said method comprising the steps of:

assembling a first jig by interconnecting a pluality of standard frames, each comprising horizontally spaced vertical beams integrally joined to vertically spaced horizontal beams, stacked upon each other in vertical planes to a desired height, which interconnected frames present an outer surface generally corresponding in shape to the polygonal shape of the inner wall of a lost casing to be produced;

assembling on and releasably attaching to the outer surface of said first jig a first plurality of plates pre-cut to predetermined sizes and shapes, thereby forming the inner wall of the lost casing;

seamlessly joining the assembled plates at abutting edges;

attaching to the inner wall a plurality of outwardly projecting spacer elements having means at their outer ends for connecting a plate thereto;

attaching to the outer ends of said spacer elements a second plurality of plates pre-cut to predetermined sizes and shapes;

seamlessly joining the attached plates at abutting edges, thereby forming the outer wall of a lost casing;

joining the inner and outer walls around their bottom perimeters to form a sharp edge;

releasing the inner wall of the lost casing from said first jig; and lifting the double-walled lost casing from said first jig.

2. Method for manufacturing a lost casing as defined by claim 1, comprising the further step of preforming openings in said second plurality of pre-cut plates which correspond in spacing and location to the spacing and location of the spacer elements projecting from said inner wall, each for receiving a respective spacer therethrough, and wherein each spacer element is formed with an abutment for engaging an interior edge of the opening and includes means for securing a plate thereto exteriorly of the abutment.

3. Method for manufacturing a lost casing as defined by claim 1, comprising the further step of, prior to attaching said second plurality of pre-cut plates to said spacer elements to form the outer wall, attaching concrete reinforcing rods on and spaced from the outer surface of said inner wall.

4. Method for manufacturing a lost casing as defined by claim 1, wherein each standard frame comprises two outer vertical beams, one for each opposite side of the inner wall of a lost casing to be produced, interconnected at least at upper and lower ends by horizontal beams, said vertical beams having inclined extensions at their lower ends which extend outwardly and downwardly toward respective horizontal bottom beams.

5. Method for manufacturing a lost casing as defined by claim 4, wherein the outer beams of each standard frame are interconnected by a triangular lattice frame.

6. Method for manufacturing a lost casing as defined by claim 5, comprising the further step of interconnecting at least one of said standard frames and one of said triangular lattice frames, thereby forming a three-dimensional frame as a part of said jig.

7. Method for manufacturing a lost casing as defined by claim 1, wherein said standard frames comprise a group of frames including a plurality of rectangular subframes and a triangular subframes, each of said subframes comprising at least a horizontal beam and a vertical beam.

8. Method for manufacturing a lost casing as defined by claim 7, wherein said rectangular subframes all have the same width, measured in a plane of the frame, and have a height chosen from a series of standard heights.

9. Method for manufacturing a lost casing as defined by claim 8, comprising the further step of interconnecting plural subframes of one specific standard height to form a three-dimensional rectangular parallelipiped.

10. Method for manufacturing a lost casing as defined by claim 8, comprising the further step of interconnecting the horizontal beams of at least two triangular subframes to form a three-dimensional frame, and wherein the length of said horizontal beams corresponds to the horizontal distance between the vertical beams of said standard frames.

11. Method for manufacturing a lost casing as defined by claim 8, including the steps of placing two standard frames at an angle with respect to each other and interconnecting the same with horizontal beams to form a frame which in plan view has the shape of a triangle.

12. Method for manufacturing a lost casing as defined by claim 11 wherein said frame in plan view has the shape of an equal sided trapezium.

13. Method for manufacturing a double-walled hollow lost casing having a bottom and planar, vertically-oriented inner and outer walls each made of assembled pre-cut plates of such size and shape that horizontal cross-sections of the lost casing at all vertical levels are inwardly and outwardly polygonal in shape, a lower portion of the casing adjacent the bottom slopes downwardly and outwardly, and the inner and outer walls are joined together to form a sharp edge around the perimeter of the bottom of the lost casing, said method comprising the steps of:

assembling a first jig by interconnecting a plurality of standard frames, each comprising horizontally spaced vertical beams integrally joint to vertically spaced horizontal beams, stacked upon each other in vertical planes to a desired height, which interconnected frames present an outer surface generally corresponding to the polygonal shape of the inner wall of a lost casing to be produced;

assembling on and releasably attaching to the outer surface of said first jig a first plurality of plates pre-cut to predetermined sizes and shapes, thereby forming the inner wall of the lost casing;

assembling a second jig by interconnecting a plurality of standard frames which together present an outer surface generally corresponding in shape to the polygonal shape of the outer wall of a lost casing to be produced;

assembling on and releasably attaching to the outer surface of said second jig a second plurality of plates pre-cut to predetermined sizes and shapes, thereby forming the outer wall of the lost casing, and seamlessly joining the assembled plates at abutting edges;

attaching to the inner wall a plurality of outwardly projecting spacer elements;

releasing the inner wall of the casing from said first jig and lifting the released inner wall away from said first jig;

releasing the outer wall of the casing from said second jig;

lifting the released outer wall away from said second jig and lowering it over said inner wall;

attaching the outer ends of said spacer elements to said outer wall, thereby connecting said outer wall to said inner wall; and joining the inner and outer walls around their bottom perimeters to form a sharp edge.

14. Method for manufacturing a lost casing as defined by claim 13, comprising the further step of preforming openings in the plates from which said outer wall is formed at locations which correspond, when the outer wall is connected to the inner wall, to the locations of the spacer elements projecting from said inner wall, each for receiving a respective spacer element therethrough and wherein each spacer element is formed with an abutment for engaging the edge of the opening and includes means for securing an outer wall-forming plate thereto exteriorly of the abutment.

15. Method for manufacturing a lost casing as defined by claim 13, comprising the further step of, prior to lowering said outer wall over said inner wall, attaching concrete reinforcing rods on and spaced from the outer surface of said inner wall.

* * * * *